US006264080B1

(12) United States Patent
Ewing

(10) Patent No.: US 6,264,080 B1
(45) Date of Patent: Jul. 24, 2001

(54) BODY MOUNTED MARKER HOLDER

(76) Inventor: Stephan C. Ewing, 1820 Old Waterman Rd., San Bernardino, CA (US) 92404

( * ) Notice: Subject to any disclaimer, the term of this patent is extended or adjusted under 35 U.S.C. 154(b) by 0 days.

(21) Appl. No.: 09/309,204

(22) Filed: May 10, 1999

(51) Int. Cl.[7] ..... A45F 5/00

(52) U.S. Cl. ..... 224/200; 224/197; 224/249; 224/251; 224/269; 24/11 R; 401/98; 401/202

(58) Field of Search ..... 224/197, 199, 224/200, 249, 251, 269; 24/11 HC, 11 CT, 11 R; 401/98, 202

(56) References Cited

U.S. PATENT DOCUMENTS

| | | | | |
|---|---|---|---|---|
| 33,894 | | 12/1861 | Lord . | |
| D. 276,479 | * | 11/1984 | Mori | 401/202 X |
| 301,122 | * | 7/1884 | Hicks | 401/98 X |
| 762,922 | | 6/1904 | Meyerpeter . | |
| 863,029 | * | 8/1907 | Holland | 24/11 P |
| 1,064,788 | * | 6/1913 | Terry | 24/11 CT X |
| 1,088,406 | | 2/1914 | Davis . | |
| 1,281,299 | | 10/1918 | Crosson . | |
| 2,415,208 | | 2/1947 | Greenberg . | |
| 2,859,516 | * | 11/1958 | McQueary | 224/197 X |
| 3,056,180 | | 10/1962 | Gink . | |
| 3,937,373 | * | 2/1976 | Artz | 224/666 |
| 4,262,833 | | 4/1981 | De Santis . | |
| 4,391,457 | | 7/1983 | Gassner . | |
| 4,564,078 | | 1/1986 | Enokido et al. . | |
| 4,674,298 | * | 6/1987 | Wimmershoff-Caplan | 224/251 X |
| 4,756,458 | | 7/1988 | Clifton . | |
| 4,830,248 | | 5/1989 | Pommenville . | |
| 4,893,739 | | 1/1990 | Conner . | |
| 5,386,932 | | 2/1995 | Gross . | |
| 5,477,999 | | 12/1995 | Blankenship, Jr. . | |

FOREIGN PATENT DOCUMENTS

| | | | | |
|---|---|---|---|---|
| 20226 | * | 11/1894 | (GB) | 401/98 |
| 25440 | * | 11/1894 | (GB) | 224/11 CT |
| 437677 | * | 11/1935 | (GB) | 24/11 CT |
| 650540 | | 7/1950 | (GB) . | |
| 805654 | * | 11/1936 | (IT) | 24/11 P |

* cited by examiner

*Primary Examiner*—Gregory M. Vidovich
(74) *Attorney, Agent, or Firm*—Price and Gess

(57) ABSTRACT

The cap of a marking device such as a felt tip marker is attached by a cap retaining device adjacent the body of a user. The barrel or marking portion of the marking device may then be readily removed, used for marking and then reinserted into the cap using only a single hand.

10 Claims, 6 Drawing Sheets

FIG. 7
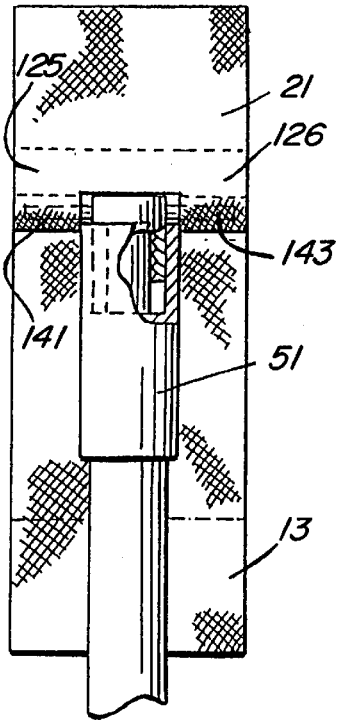
FIG. 8
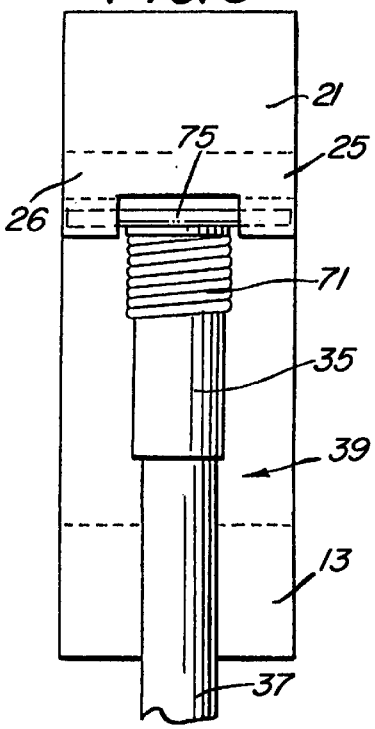
FIG. 9
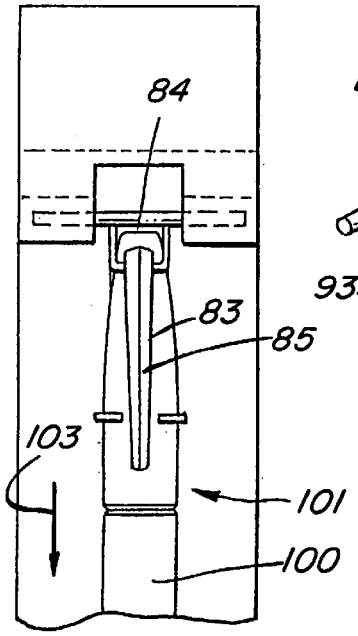
FIG. 10
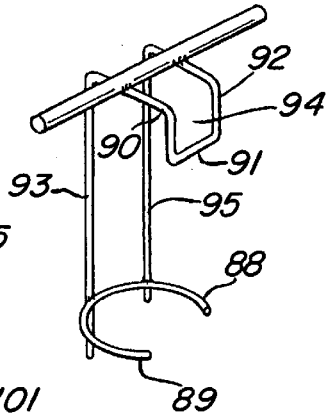
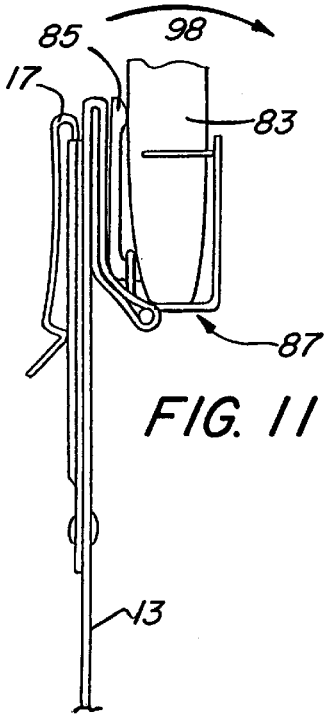
FIG. 11

BODY MOUNTED MARKER HOLDER

BACKGROUND OF THE INVENTION

1. Field of the Invention

The subject invention relates generally to holders for marking devices and more particularly to apparatus readily adaptable for mounting conventional marking devices adjacent the body of a user, and particularly such marking devices as typically employed in the construction industry.

2. Description of the Related Art

Marking devices are commonly used in many occupations for marking, drawing or writing. Such devices include, for example, felt tip pens, paint pens and artist pens. Construction workers, warehouse workers and postal employees are just a few examples of users of such devices.

Such marking devices typically consist of two parts: (1) a stick, barrel or marker portion having a tip and (2) an airtight cap which snaps or press fits onto the stick portion. They are often carried in a shirt or pants pocket or a tool belt pouch. Typically, before use, the user must locate and pick up the marker, then grip the barrel of the marker in one hand while gripping the cap in the other hand in order to pull the cap off. This procedure leads to a number of problems.

For example, in the case of construction workers, a marker is often used in conjunction with a measuring tape to measure a piece of building material to be cut to a certain size. The worker first applies the tape to the piece of building material. Next, the worker must mark the material for cutting. To mark the material, the worker must remove the marker from his or her pocket or carrying pouch and then remove the cap from the marker. At present, the cap is often removed by placing the marker cap in the worker's mouth, biting the cap, and pulling the marker barrel free, all the while struggling to keep the measuring tape in its proper place with the other hand. The difficulty of executing this maneuver is often compounded by the fact that the worker may be measuring atop a ladder. Moreover, in the course of executing such maneuvers, the cap is often laid aside and lost.

One might suppose that such difficulties could be avoided by removing the cap first before measuring. This approach is not usually practical either, because it is usually necessary to use both hands in order to extract and hook the end of the measuring tape, especially with long measurements.

SUMMARY OF THE INVENTION

According to the invention, apparatus is provided for retaining the cap of a marking device adjacent the body of a user while the marking portion of the device is in use. The present invention facilitates (but does not require) convenient one-handed use of felt-tip and other marking pens.

The invention further contemplates a method of using a marking stick designed to be inserted into a cap comprising the steps of attaching a cap adjacent the body of a user of the stick, inserting the stick into the cap, and withdrawing the stick from the cap when it is desired to use the stick for marking purposes.

BRIEF DESCRIPTION OF THE DRAWINGS

The objects and features of the present invention, which are believed to be novel, are set forth with particularity in the appended claims. The present invention, both as to its organization and manner of operation may be best understood by reference to the following description, taken in connection with the accompanying drawings.

FIG. 7 is a partial front view of an alternate embodiment for use with the second style marker device;

FIG. 8 is a partial front view of an alternate embodiment for holding marking devices like those shown in FIGS. 2 and 3 or 7;

FIG. 9 is a front view illustrating a third embodiment useable with a third style marking device;

FIG. 10 is a perspective view illustrating the marking device retainer component of the embodiment of FIG. 9;

FIG. 11 is a partial side view useful in illustrating operation of the embodiment of FIGS. 9 and 10.

DETAILED DESCRIPTION OF THE PREFERRED EMBODIMENTS

Figure 1:
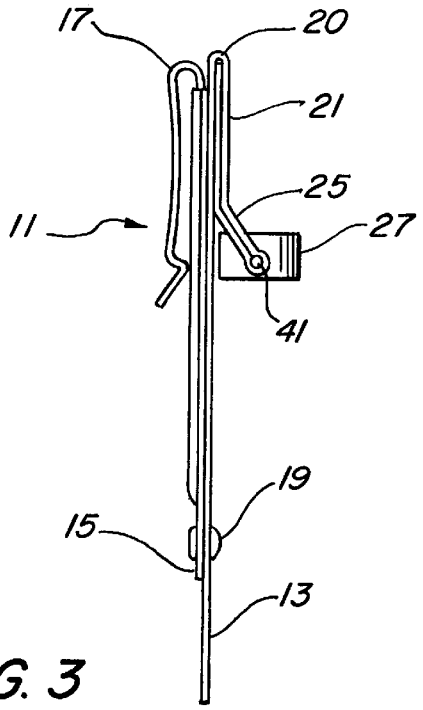
FIG. 1 is a side view of a marker holder according to the preferred embodiment.

The following description is provided to enable any person skilled in the art to make and use the invention and sets forth the best modes contemplated by the inventor of carrying out his invention. Various modifications, however, will remain readily apparent to those skilled in the art.

FIGS. 1–4 illustrate a first preferred embodiment marker holder 11 for use with a first style marking device 39. The marking device 39 includes a cap 35, which typically snaps onto a marking portion or body 37 of the device 39. Typical of the marking devices 39 which may be retained by the embodiment of FIGS. 1–4 are the marking devices sold under the trademark "HI-LITER®."

As shown in FIG. 1, the holder device 11 includes a main body piece 13, a retainer flap 15 and a mounting clip 17. The main body piece 13 and retainer flap 15 may be fabricated of sturdy fabric, such as leather, cloth or synthetic material, including woven poly or nylon webbing.

The main body piece 13 is folded over at bend 20 to create downturned flap portion 21. The main body piece 13 is then folded back on itself and suitably cut to create two depending flaps 25, 26, defined at their top-most edge by a stitch line 23. At the stitch line 23, the downturned portion 21 is stitched to the portion of the main body piece 13 lying behind portion 21.

Figure 2:
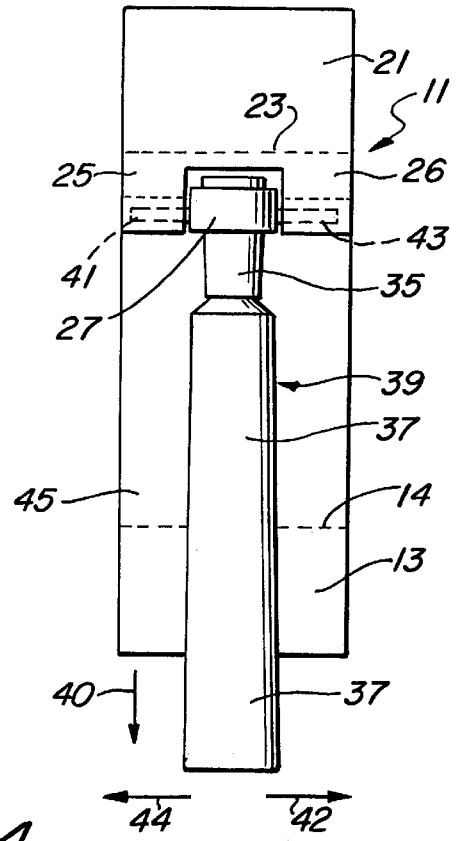
FIG. 2 is a front view of the holder of FIG. 1, with a marking device installed.
Figure 3:
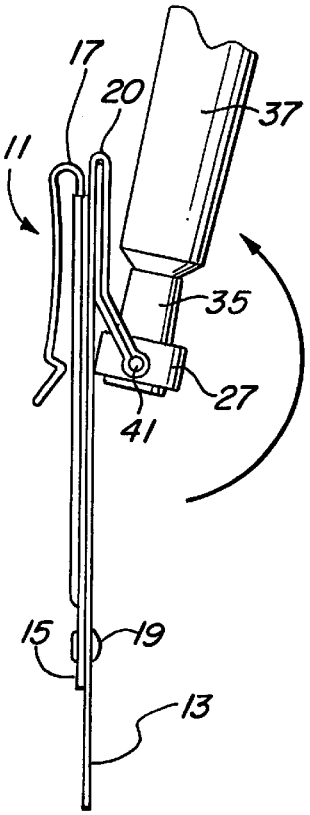
FIG. 3 is a partial side view of the holder of FIG. 1, illustrating the holder nut rotated 180° degrees in preparation for insertion of the marking portion of the marking device into the cap of the device.
Figure 4:
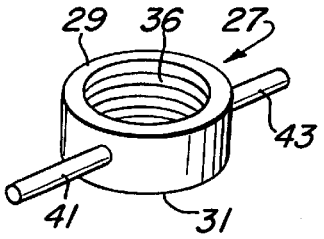
FIG. 4 is a perspective view of the nut or cap retainer component of the device of FIG. 1.

As best seen in FIG. 2, the folds of the depending flap portions 25, 26 accommodate respective pivot arms 41, 43 which are welded or otherwise fixably attached to a metal nut 27. The nut 27 has a top edge 29, a bottom edge 31 and is internally threaded as illustrated in FIG. 4.

The retainer flap 15 is stitched to the main body piece 13 along stitch line 14 and glued elsewhere along its edges to the main body piece 13. The retainer clip 17 includes a vertical depending portion (not shown) which is sandwiched by the main body piece 13 and retainer flap 15. All three of these pieces 13, 15, 17 are further fastened together by a rivet 19 or other suitable fastener.

In operation, the cap 35 is removed from the body 37 of the marking device and inserted downwardly through the nut 27 to assume the position shown in FIG. 2. The nut 27 retains the cap 35.

Since the cap 35 is formed of relatively soft plastic, it may be screwed into the nut 27 in such a fashion that the threads 36 bite into and retain the plastic cap 35. In this aspect, the threads 36 of the device may be considered as being "self-tapping" and the cap 35 may be said to interlock with the nut 27. With the cap 35 preferably in the position illustrated in FIG. 3, the body 37 of the marking device 39 is then snap-fitted back into cap 35 and is ready for use.

When it is desired to use the marking device 39, the marking portion of the device 37 may be extracted by pulling it vertically downward in the direction of the arrow 40 (FIG. 2) to expose the tip of the marking portion 37 of the device 39. When use of the marking portion 37 is complete the marking portion 37 is simply reinserted by snapping it into the cap 35 which still remains attached to nut 27. Such reinsertion may best be accomplished when the cap 35 is in the position shown in FIG. 3. It will be apparent that the marking portion 37 can be extracted for use in the downward position shown in FIG. 2 or at any desired angle between the downward position of FIG. 2 and the vertical position of FIG. 3, if desired. The nut 27 may also have a funnel-shaped (conically tapered) threaded interior. Such an interior may more suitably accommodate caps 35 which are wider at the top than the bottom and can be inverted to accommodate caps which are narrower at the top than at the bottom.

It may be noted that the flexible nature of the fabric employed in fabrication of the preferred embodiment permits the marking device to move sidewardly in the direction of either of the arrows 42 or 44 in FIG. 2. Such sideward flexibility can also be provided by pivotally mounting the cap or cap-retaining component to pivot sidewardly, i.e., clockwise or counterclockwise. For example, pivot arms 41, 43 can be attached to a plate, which is in turn pivotally mounted to the clip 17. Sideward flexibility together with the pivotal nature of the mounting of the nut 27 permits the device to be clipped to a belt via clip 17 and to then adapt to user movements, for example, to move from one side to the other when the user sits down. Another advantage is that the extended or apron portion 45 of the main body piece 13 provides protection against marking of the user's pants when the marking portion 37 is being extracted.

If desired, a simpler embodiment can be provided wherein only a clip 17, an apron portion, and a cap mounting/retaining device are employed. In such an embodiment, the apron may be a piece of material having a top edge attached to a rivet such as rivet 19 and a cap retaining device attached directly to the clip 17.

It may be further noted that the cap portion 35 could be a permanent metallic piece attached to the nut 27 or formed as a unitary part thereof, in which case multiple body portions 37 could be inserted into such a cap portion with their conventional plastic cap being discarded. Furthermore, while FIGS. 1–4 illustrate a marker holder apparatus which is particularly suited to be clipped to a belt, it should be appreciated that suitable or equivalent components of the disclosed marker holder apparatus could also be formed as part of a tool belt or tool pouch such as conventionally worn about the waist of various tradesmen.

Figure 5:
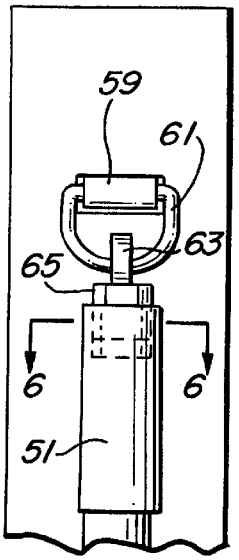
FIG. 5 is a front view of a second preferred embodiment usable with a second style of marker device.

FIG. 5 illustrates a second embodiment for use with a second type of marking device. This embodiment employs a sleeve 59 having a ring 61 pivotally mounted with respect thereto. This sleeve 59 may be attached, if desired, to a clip such as clip 17 in FIG. 1 by welding or by other attachment means. The ring 61 is inserted into a second ring 63, which is fixably attached by welding or other means to a nut 65. The insertion of ring 61 through ring 63 provides pivotal motion of the nut 65 in and out of the page.

Figure 6:
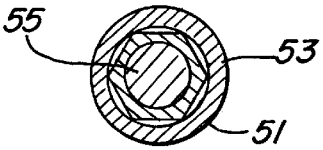
FIG. 6 is a top view of the cap of the second style marker device.

The nut 65 is particularly adapted to retain the cap 51 of the second style marking device. This cap 51 is shown in FIG. 6 and includes an outer circular rim 53 and an inner plug 55 having a circular perimeter. A gap of annular cross section is defined between the inner perimeter of the rim 51 and outer perimeter of the plug 55. The nut 65 sized to fit into this annular opening and preferably carries internal threads, which cut into and interlock with the inner plug 55 in self-tapping fashion.

An embodiment can be made that does not have a second ring (item 63). Instead, an enlarged hole is drilled in the nut 65. Also, instead of sleeve 59, a variation of ring 61 is attached directly to the clip 17 at 90°. This configuration is a much simpler design which achieves the same result as the one in FIG. 5. Up and down flexibility is provided the same way as FIG. 5 with the side to side movement provided by the enlarged hole through nut 65 as well as the inherent flexibility provided by the clip to belt mount. An advantage of this design is that it holds the cap over the marker guard flap, whereas the style in FIG. 5 is a bit floppy.

FIG. 7 illustrates an alternate embodiment for use with the second style marking device. This alternate embodiment differs from that of FIG. 5 in that the nut 65 is provided with two pivot arms 141, 143 which are inserted into adjacent flaps 125, 126 in the manner shown and discussed with respect to FIG. 2.

FIG. 8 illustrates an alternate embodiment suitable for use with marking devices like device 39 illustrated in FIG. 2. This embodiment employs a "Chinese finger clamp" 71 to retain a marking device cap. Opposite ends of a pivot arm 75 are retained by respective flaps 25, 26. The finger clamp 71 is of such a nature that, if the cap 35 is twisted and pushed into it in one direction, the cap 35 becomes firmly gripped by the clamp 71, whereas, if the cap 35 is twisted in the same direction, and pulled out, it readily releases from the clamp 71.

FIGS. 9–11 illustrate apparatus for retaining the mounting cap of a third style marker 101. The cap 83 of this third marking device 101 is conically tapered and rounded to a top most edge 84 and has a clip 85 mounted to its side face.

The cap 83 is received and grasped by a special retainer 87 best illustrated in FIG. 10. This retainer 87 includes parallel, vertically depending side legs 93, 95 and horizontal arms 88, 89 extending from the legs 93, 95. At the top of the retainer 87, the legs 93 form into a U-shaped portion having downwardly depending arms 90, 92 attached by a cross piece 91.

To insert the cap 83 of the marking device 101 into the retainer 87, the cap 83 is inverted as shown in FIG. 11 and the clip 85 is inserted into the gap 94 between the respective arms 90, 92. The cap 83 is then rotated clockwise in the direction of the arrow 98 in order to reach the position shown in FIG. 9. The marking portion 100 of the device 101 may then be extracted from the cap for marking purposes by pulling it downwardly in the direction of the arrow 103.

Figure 12:
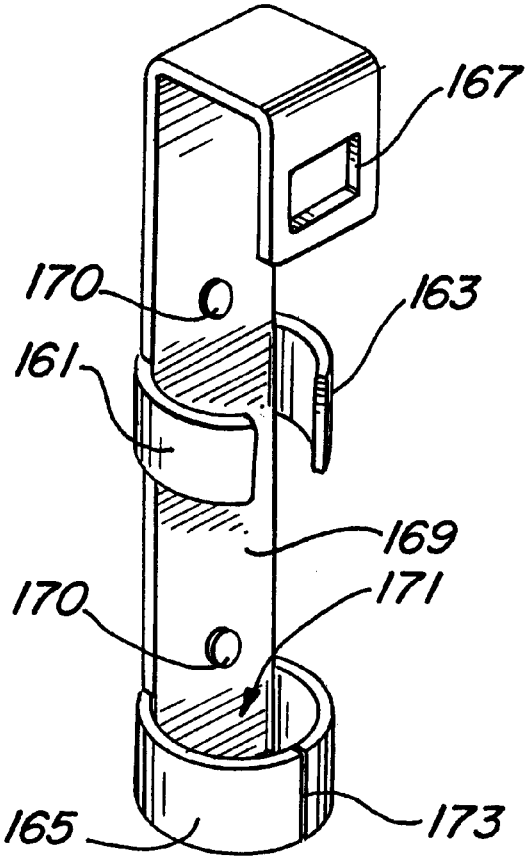
FIG. 12 is a perspective view of an alternate embodiment retainer device useable with a third style marker.
Figure 13:
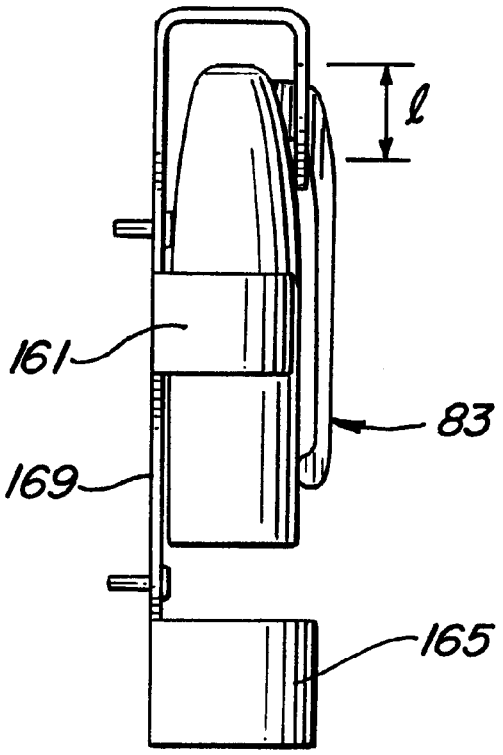
FIG. 13 is a side view illustrating the embodiment of FIG. 12.
Figure 14:
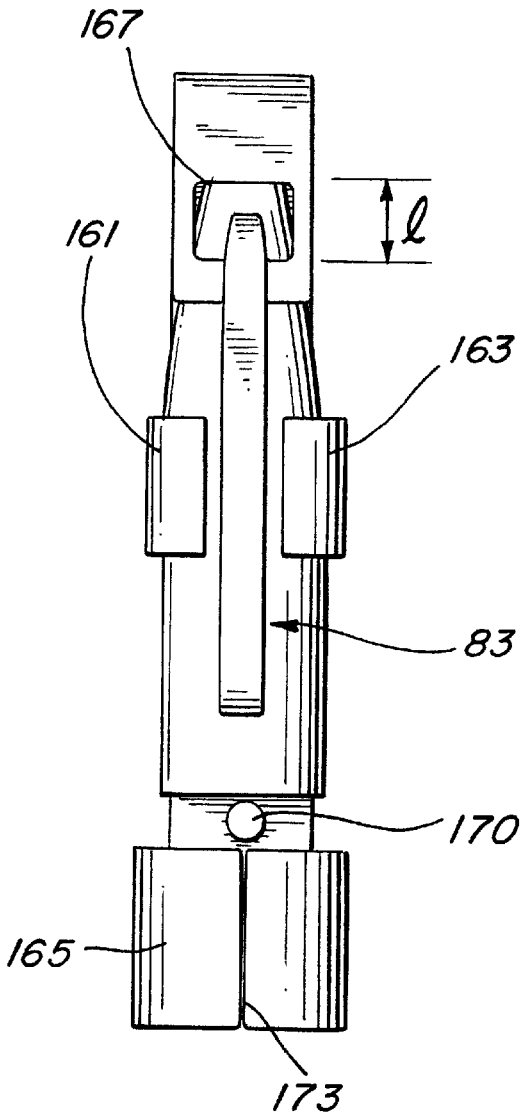
FIG. 14 is a front view illustrating the embodiment of FIG. 12.

FIGS. 12–14 illustrate another embodiment useful, for example, with the third style marker, e.g., 101. This embodiment employs arcuately shaped clip arms 161, 163, a barrel guide 165, and a pen clip receiver slot 167, all integrally formed with a vertically disposed back portion 169. Rivet holes 170 may be provided to facilitate attachment to a belt, pouch, apron or other surface, if desired. Various other attachment mechanisms, such as those illustrated herein, are of course applicable. The embodiment of FIGS. 12–14 is preferably made of metal, such as, for example, spring steel.

The barrel guide 165 provides a cylindrical opening 171 split into two halves along split 173. The barrel guide 165 provides support to the barrel, e.g. 100, of a marking device to assist in preventing inadvertent unclipping of the cap, e.g., 83. The barrel guide 165 may be omitted in various embodiments. The length "l" of the receiver slot 167 is preferably selected to accommodate various cap shapes of commercially available markers.

Figure 15:
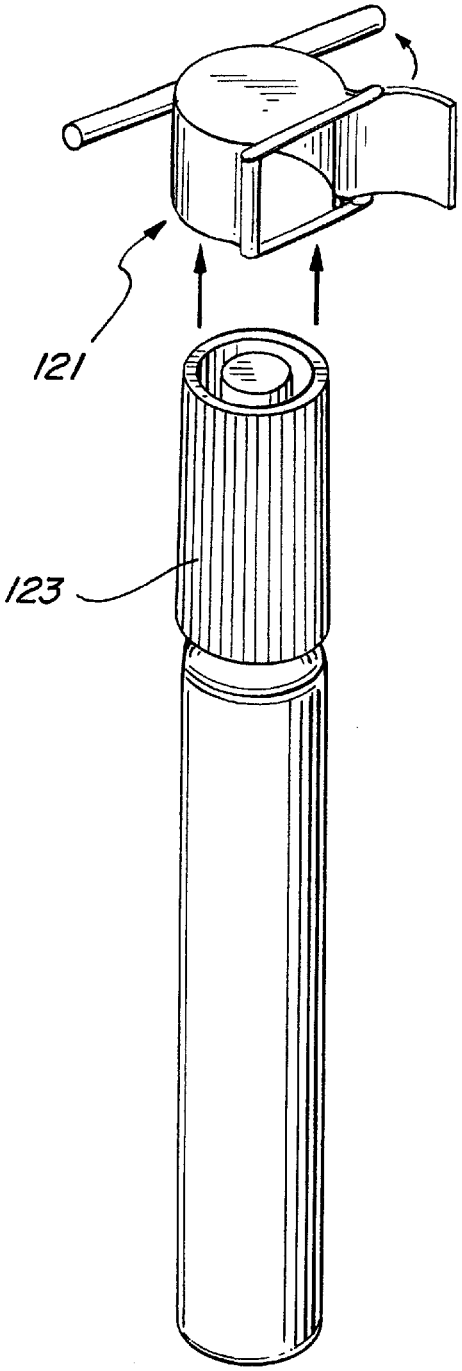
FIG. 15 is perspective view of an embodiment employing a buckle-style clamp.

The embodiments of FIGS. 1–8 provide a number of examples directed to retaining marker caps without built-in clips. These and other alternate embodiments may be described as follows:

1. Self-tapping nut. This form of attachment utilizes a machine-threaded nut that self taps onto a plastic marker cap. The threads of the nut may tap onto the outside or inside of the marker cap, depending on the particular type or brand of cap being attached. It is possible to make a multiple threaded holder to accommodate more than one brand of marker. For example, two different thread diameters may be provided, one on each end of the nut. This configuration allows the same holder to attach either Dixon or Sanford brand marks as well as many others with the same diameter cap. The outside of the holder nut may also be threaded in order to create a single holder to fit even more brands of caps. Also, a slight taper to the threads may ease tapping as well as accommodate more brands of markers. Most marker cap's inside nib cover (the round part inside the outer grip portion) are very close in diameter. Of course, pre-threaded caps may also be provided.
2. Chinese finger trap style, e.g. FIG. 7.
3. A buckle style clamp 121 such as illustrated in FIG. 15 applied around the outside circumference of a cap, e.g. 123. Such a clamp can be made adjustable to accommodate different size caps. These style clamps are common; most fire extinguishers attach to a wall bracket with such a clamp.
4. Hose clamp style and other releasable clasp styles also could fit a wide range of circumferences.
5. Encapsulated cap wherein a particular shape of cap is either partially or wholly encapsulated by a suitably shaped holder. Such an encapsulation can constitute a mated counter part into which the cap is inserted. The mated counterpart is so designed so that when the cap is fully inserted it is retained by structural features of the encapsulation device. For example, during insertion, the cap may push aside one or more flexible clips. Such a clip or clips, upon full insertion, snap over the end of the cap thereby holding the cap within the encapsulation. To remove the cap from such an encapsulation one simply pushes aside the clip or clips, thus freeing the cap for removal.

Figure 16:
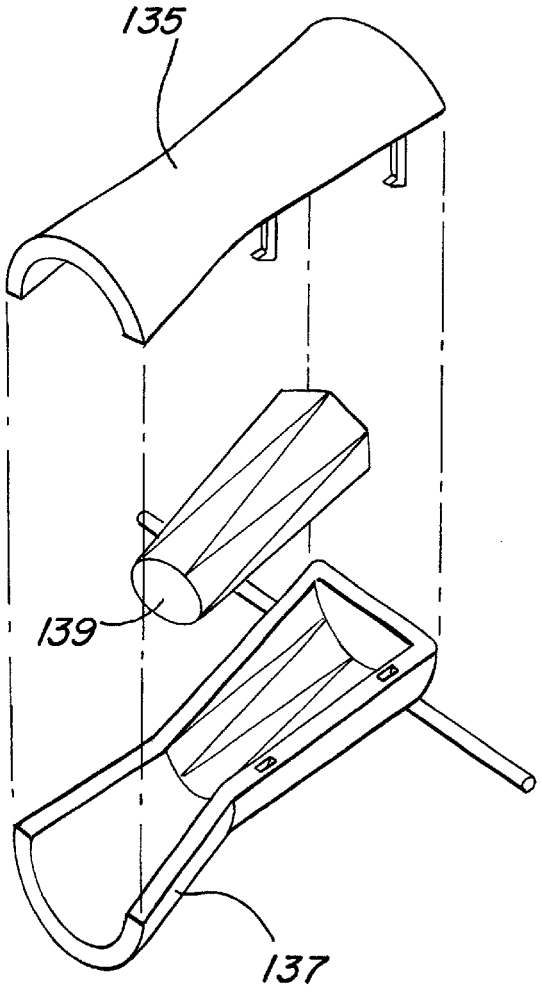
FIG. 16 is a perspective view of an embodiment employing an encapsulated cap.

The encapsulation can contain a funnel-shaped entrance at the cap opening included in its design to ease reinsertion of the marker barrel. Such a funnel shape can also aid in securing the marker barrel against accidental dislodging. Such an encapsulation can be made of one or more pieces of molded plastic or can also be made of metal or other suitable material, or a combination thereof. Other means of encapsulation are possible and readily apparent to anyone skilled in the art. An encapsulation employing halves 135, 137 as shown in FIG. 16, would snap together, thus firmly holding the cap, e.g. 139, in place. As noted, such an encapsulation could include a funnel-shaped entrance in order to make it easier to replace the marker back into the holder.

Figure 17:
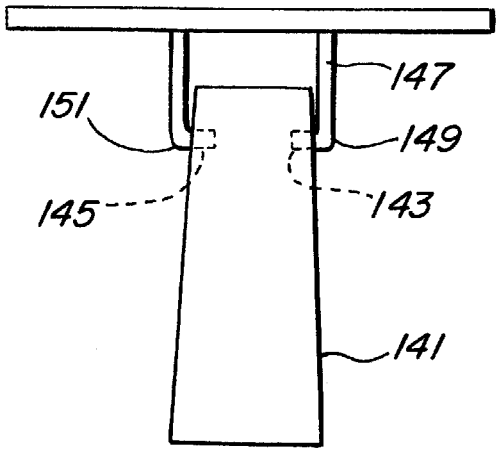
FIG. 17 is a front view of an embodiment employing a perforated cap.
Figure 18:
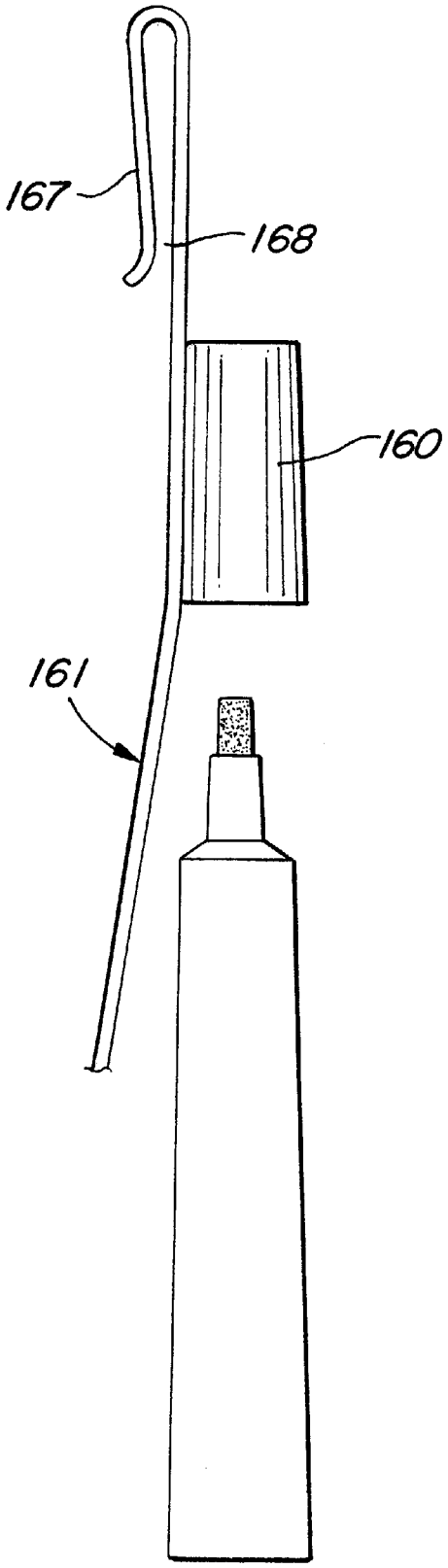
FIG. 18 is a side view of an embodiment fabricated as a molded plastic part.
Figure 19:
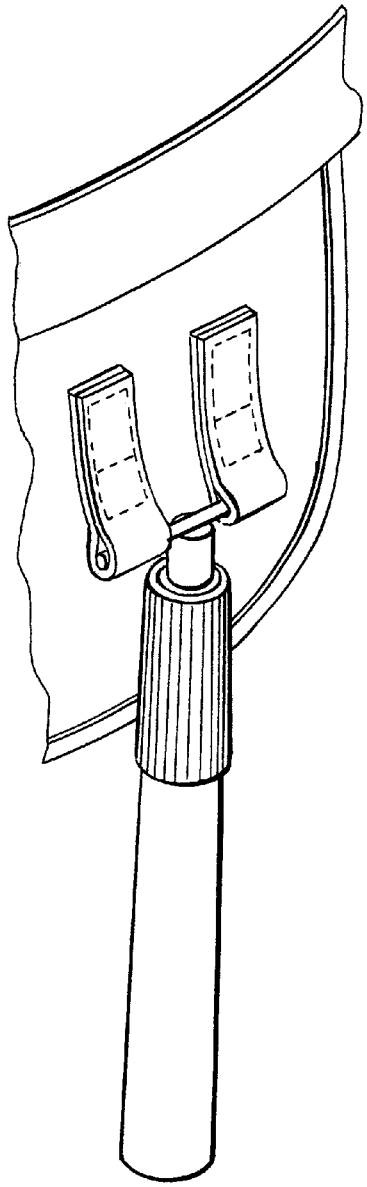
FIG. 19 is perspective view illustrating attachment of a cap-retaining device to a tool apron.

6. Cap pre manufactured with one hole through the outer shell grip portion. This configuration would allow for the cap to be inserted into a socket of suitable material. A hole in the socket would then be aligned with the hole in the cap allowing the insertion of a snap or screw in order to firmly secure the cap to the socket holder.
7. A cap, such as cap 141 of FIG. 17, made with two opposing holes or indentations as 143, 145. One way of attachment is the use of a C-clip 147. The cap 141 accepts the two inwardly projecting ends 149, 151 of the clip 147, thus securing the cap 141. Another possibility, utilizing two opposing holes, would require the cap to be made with the outer shell slightly longer with two opposing holes in the lengthened portion. A rod would then be inserted through the cap.
8. Pre-molded cap with depressions or protruding clips. Either of these configurations would allow the cap to be snapped directly to a mated counterpart.
9. Permanent durable cap made of high quality durable material such as metal or other suitable material. Such a cap would be permanently or removably attached to holder. With plastic barreled markers the entire cap could be made of such material. (The plastic of the barrel provides the sealing means). Metal barreled markers would require the addition of an O-ring seal made of a suitable long lasting material such as nylon, for example.
10. One-piece plastic molded cap 160, belt-clip 167, and mark-guard 161 all in one, such as illustrated in FIG. 18. A plastic hinge 168, molded just below the clip 167 may optionally be provided for flexibility. Plastic forming and molding techniques may be applied to simplify and reduce part count and cost of various embodiments disclosed herein and variations thereof.
11. FIG. 19 illustrates employment of a fabric hinge or hinges as one of many possible attachment mechanisms for mounting a cap-retaining mechanism to a tool belt or apron. Other mechanisms include stiff metal or plastic protruding hinges or rings suitably attached at their base directly to the tool apron or other article of wear. Up and down movement would be provided in the same way as in the many embodiments previously described. Sideways flexibility would be inherently provided by the flexibility of the article of wear itself.

Those skilled in the art will appreciate from the many illustrative embodiments disclosed above that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. An apparatus comprising:

a fabric body of rectangular shape having a front face and a back side;

a mounting clip mounted to the back side of said fabric body, said mounting clip having a closed end disposed adjacent a top edge of said body;

a portion of material extending from the front face of said fabric body and located parallel to and below said top edge;

means cooperating with said portion of material for retain marking device cap and for mounting said cap such that said cap is pivotable outwardly and away from said fabric body in a plane perpendicular to said fabric body; and said front face of said fabric body extending below said portion of material a distance sufficient to form an apron for preventing a marking portion releasably retained by said cap from marking on apparel of a user when said marking portion is removed from said cap, wherein said means cooperating with said portion of material comprises first and second horizontal channels formed in respective first and second adjacent flaps extending from said portion and first and second retainer arms respectively mounted in said first and second channels.

2. The apparatus of claim 1 wherein said marking device cap is pivotable to an angle which enables insertion of the marking portion into said cap along a direction substantially extending from said closed end of said mounting clip toward an open end of said mounting clip.

3. The apparatus of claim 1 wherein said fabric exhibits a flexibility selected to permit the marking portion to pivot in a plane parallel to said front face so as to adapt to user movements.

4. The apparatus of claim 1 wherein said means cooperating with said portion of material fixedly mounts a cap between said arms which is useable with a plurality of possible marking portions.

5. An apparatus comprising:

a fabric body of rectangular shape having a front face and a back side;

a mounting clip mounted to the back side of said fabric body, said mounting clip having a closed end disposed adjacent to a top edge of said body;

first and second flaps, each having a respective first and second horizontal channel formed therein, said first and second flaps being disposed adjacent one another on the front face of said body such that said first and second channels are colinear;

means for releasably retaining a marking device cap, said means comprising first and second retainer arms respectively mounted in said first and second horizontal channels such that said cap is pivotable outwardly and away from said body in a plane perpendicular to said body; and said front face extending below said first and second flaps a distance sufficient to form an apron for preventing a marking portion releasably retained by said cap from marking on apparel of a user when said marking portion is removed from said cap.

6. The apparatus of claim 5 wherein said marking device cap is pivotable to an angle which enables insertion of the marking portion into said cap along a direction substantially extending from said closed end of said mounting clip toward an open end of said mounting clip.

7. The apparatus of claim 5 wherein said fabric exhibits a flexibility selected to permit the marking device to pivot in a plane parallel to said face so as to adapt to user movements.

8. The apparatus of claim 5 wherein said means for retaining comprises a nut located between said first and second arms and attached thereto, said nut having a central opening for receiving and retaining a cap which in turn receives and releasably retains said marking portion.

9. The apparatus of claim 5 wherein said means for retaining comprises a retainer clip adapted to retain a conically tapered marking device cap.

10. The apparatus of claim 5 wherein said means cooperating with said portion of material fixedly mounts a cap between said arms which is useable with a plurality of possible marking portions.

* * * * *